US007823726B1

(12) United States Patent
Miceli et al.

(10) Patent No.: US 7,823,726 B1
(45) Date of Patent: Nov. 2, 2010

(54) NESTLED LABELS FOR MEDICINE CONTAINER

(75) Inventors: David A. Miceli, Reno, NV (US); Joseph A. Miceli, Spencer, TN (US)

(73) Assignee: Tri State Distribution, Inc., Sparta, TN (US)

( * ) Notice: Subject to any disclaimer, the term of this patent is extended or adjusted under 35 U.S.C. 154(b) by 0 days.

(21) Appl. No.: 12/209,197

(22) Filed: Sep. 11, 2008

Related U.S. Application Data

(60) Provisional application No. 60/971,432, filed on Sep. 11, 2007, provisional application No. 60/971,431, filed on Sep. 11, 2007, provisional application No. 60/971,575, filed on Sep. 12, 2007.

(51) Int. Cl.
*B65D 85/00* (2006.01)
*G09F 3/00* (2006.01)
*B42D 15/00* (2006.01)

(52) U.S. Cl. ..... 206/459.5; 40/310; 283/81; 283/105

(58) Field of Classification Search ..... 206/459.1, 206/459.5; 40/306, 310, 638, 312; 283/56, 283/81, 105
See application file for complete search history.

(56) References Cited

U.S. PATENT DOCUMENTS

| | | | | |
|---|---|---|---|---|
| 1,273,105 | A | 7/1918 | Dyke et al. | |
| 2,091,346 | A * | 8/1937 | Wright | 40/310 |
| 4,345,393 | A * | 8/1982 | Price et al. | 40/312 |
| 4,666,185 | A * | 5/1987 | Pilborough | 283/81 |
| 5,046,609 | A | 9/1991 | Mangini et al. | |
| 5,324,559 | A * | 6/1994 | Brombacher | 283/56 |
| 5,329,713 | A * | 7/1994 | Lundell | 40/310 |
| 5,342,093 | A | 8/1994 | Weernink | |
| 5,380,045 | A * | 1/1995 | Comann | 283/81 |
| 5,822,735 | A | 10/1998 | De Lapa et al. | |
| 5,958,536 | A * | 9/1999 | Gelsinger et al. | 283/81 |
| 6,036,231 | A | 3/2000 | Foote et al. | |
| 6,167,679 | B1 | 1/2001 | Horton-Steidle et al. | |
| 6,217,078 | B1 | 4/2001 | Roth et al. | |
| 6,240,394 | B1 | 5/2001 | Uecker et al. | |
| 6,304,849 | B1 | 10/2001 | Uecker et al. | |
| 6,621,629 | B2 | 9/2003 | Blumenthal | |

(Continued)

FOREIGN PATENT DOCUMENTS

| | | |
|---|---|---|
| JP | 2003034335 | 2/2003 |

(Continued)

OTHER PUBLICATIONS

Label land: multi-panel labels open up new market opportunities for Ontario label-marker, MacDonald, Jason, Canadian Packaging. Toronto: Dec. 1999 vol. 52, Iss. 12; p. 12.

*Primary Examiner*—Bryon P Gehman
(74) *Attorney, Agent, or Firm*—Waddey & Patterson, P.C.; Phillip E. Walker

(57) ABSTRACT

A labeling and a method of labeling adapted for pharmaceutical containers having multiple printed indicia locations varying in size and containing information for a user of varying sized pharmaceutical containers. The labeling includes a single substrate having several labeling options and can be designed with multiple main die cut portions separating various sections of the label such that various size labels can be produced from the single substrate.

8 Claims, 10 Drawing Sheets

U.S. PATENT DOCUMENTS

| | | | | |
|---|---|---|---|---|
| 6,715,796 | B2 | 4/2004 | Foote et al. | |
| 7,185,453 | B2 * | 3/2007 | Spear et al. | 40/638 |
| 7,438,322 | B2 * | 10/2008 | Miller | 283/81 |
| 2003/0061750 | A1 * | 4/2003 | Bernier et al. | 40/638 |
| 2003/0112466 | A1 | 6/2003 | Leonardi | |
| 2004/0111934 | A1 * | 6/2004 | O'Connell | 40/310 |
| 2005/0102179 | A1 | 5/2005 | Caplinger et al. | |
| 2005/0154641 | A1 | 7/2005 | Mortimer | |
| 2005/0209915 | A1 | 9/2005 | Saluccio | |
| 2006/0028014 | A1 | 2/2006 | McQueeny et al. | |
| 2008/0100054 | A1 | 5/2008 | Richards | |
| 2008/0284156 | A1 * | 11/2008 | Ugolick et al. | 283/81 |
| 2009/0039640 | A1 | 2/2009 | Nijjer et al. | |

FOREIGN PATENT DOCUMENTS

| | | |
|---|---|---|
| JP | 3151043 | 6/2009 |

* cited by examiner

NESTLED LABELS FOR MEDICINE CONTAINER

CROSS-REFERENCES TO RELATED APPLICATIONS

This application is a non-provisional of co-pending U.S. Patent Application Ser. No. 60/971,432, filed Sep. 11, 2007, entitled "Nestled Labels for Medicine Containers"; 60/971,431 filed Sep. 11, 2007, entitled "Multiple Label Size Options for Medicine Containers"; and 60/971,575 filed Sep. 12, 2007, entitled "Distinct Label Panels with Revised Indicia on Prescription Medicine Containers"; all of which are incorporated by reference in their entirety.

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

The present invention relates generally to a label that may be applied to a vial, bottle, or other container having a closure, which may be described as a cap or a top. The combination of the container and closure can be described as a closure container assembly or system and the closure and container assembly are designed to store and dispense materials, particularly pharmaceuticals. The label is specifically design to allow a user to have options as to the size of the label positioned on the container in such a manner as to relay information, such as information concerning the medicine or advertising, to a person that subsequently uses the container enclosure system. The label is also specifically design to facilitate minimization of the label and its substrate as the label and its substrate are produced while providing the label in a user friendly and at least partially automated format.

There are many types of closure systems described in the art. For example there are closures that are child resistant, closures that are non child resistant, and closures that are convertible from child resistant to non child resistant, from non child resistant to child resistant, or convertible between the two modes multiple times. Most of the technology in this field has been directed at improving the container and/or closure, or the interface between the container and closure.

Very little advancement has been directed towards the labeling or information provided with the pharmaceuticals or the labeling attached to the container. Typically this labeling is oriented such that the lines of alphanumeric characters are substantially perpendicular to the axis of a container. This can pose a problem for a user of the container in the reading of the information contained on the label.

Additionally, prior art labels are usually printed in a single size in order to simplify inventory and procedures at the pharmacies. As a result, the label sizes are designed for the smallest containers, which leave a majority of the circumferential space unused on larger containers that use the smaller labels. This can result in the use of smaller sized font than necessary which can be hard to read.

For example, typically the smaller containers have small diameters such that words having anything but more than a few letters require the holder of the container to rotate the container about its axis in order to be able to read the information contained thereon. This is especially cumbersome given the multiple characters and/or letters that comprise most medicines, which can be upwards of 15-20 letters long. Additionally, since these smaller sized labels and fonts are generally used on the larger containers, the information contained thereon is still hard to read even given the larger diameters of the larger containers. Any warnings on the labels in the form of sentences or small paragraphs require multiple turns and/or rotations of the container in order for a user to be able to read that information or are in a smaller font than necessary. This can be annoying and troublesome to the user and does not facilitate an ease of information transfer from a label to the user of a container.

Another factor in the application of the labeling to the containers is the need for an ergonomic label design with respect to the containers and an ergonomic process for the actual selection of the labels by the user, such as a pharmacist, and placement of those label by the same on the containers Up until this point the space on a pharmaceutical container, namely the label or labels positioned thereon, have been used to provide information concerning the pharmaceuticals contained therein including the dosage warnings and other pertinent information. Portions of this space have been unused or at least under utilized.

In light of the foregoing there is a need for revised labeling on a pharmaceutical container. The revised labeling preferably maximizes the readability of the information, medical or otherwise, positioned on the pharmaceutical container such that a reader of that information can readily read, ascertain and comprehend the information. The revised labeling preferably minimizes any procedures for the placement of that labeling on the containers. This needed labeling is lacking in the art.

BRIEF SUMMARY OF THE INVENTION

The present invention is directed to labeling adapted for use in a closure and container system that can substantially obviate one or more of the problems due to limitation and disadvantage of the related art. Additional features and advantages of the invention will be set forth in the description which follows, and in part will be apparent from the description, or may be learned by practice of the invention. The objects and other advantages of the invention will be further realized and attained by those features of the invention particularly pointed out in the description and claims hereof as well as the appended drawings.

The present invention is directed to labeling positioned on a pharmaceutical container that increases the readability of information positioned on the pharmaceutical container and can vary the size of the labeling with respect to the container in which the pharmaceuticals are positioned.

The labeling is used in connection with a pharmaceutical storing and dispensing device having a closure and container. The pharmaceutical storing and dispensing device includes a label having alphanumeric indicia containing information, such as medical information, advertising, and the like.

These alphanumeric indicia can be orientated on the label in multiple manners, such as substantially parallel or perpendicular with the axis of the container. Medical information can include the patient's name, name of the medicine, and optionally other medical information positioned on the container. The advertisement can be any advertisement, but preferably is directed at medical goods or services or goods or services that are geographically specific to the user and/or patient of the pharmaceutical container.

The container includes a bottom and a neck having an opening and one or more engaging devices positioned and shaped to interact with corresponding engaging devices on the closure. The axis of the container runs through the opening and bottom of the container. The preferably sized label includes indicia oriented to increase readability of the same on the container.

A single substrate could have several labeling options and could be designed with multiple main die cut portions separating various sections of the label. For example, in a traditional peel and stick label configuration the various sections of the labels could be separated by perforations. The perforation could allow each label to be pulled apart from other sections, for example other peel and stick sections, or torn away as both a peel and stick section and the bonded sections that are glued to the peel and stick portion.

Additionally, the current invention can include positioning multiple labels on a single substrate such that various size labels can be produced from the single substrate. For example, the multiple labels that are precut, or perforated, can be positioned on a single substrate such that the multiple labels are stacked, or nestled, within each other. For example, a smaller label can be nestled within a larger label such that the smaller label can be picked or the larger label can be picked such that it encompasses the smaller label. The size of the label is preferably decided before any indicia, or print, is positioned on the labels such that the selected label maximizes the amount of label space and/or readability of the indicia for a given size container.

This allows the use of one printed document or one general label with sub-labels or subsections for multiple container sizes. The substrate can be various substrates known in the art such as sheet labels or roll labels.

Software can be designed in an operating system to correspond with the varying size containers, normally dependent upon the size and amount of the pharmaceutical contained in the container, to produce a single label. The single label can be selected in size from several options based upon the size of the container to which the label shall be attached. The indicia printed on the label is selected based on the size of the container can be increased and or maximized to increase either the amount of information placed on that label or the readability of the information placed on a label.

As such, the preferred sub-label, which can also be described generally as an individual label or a preferred label for a particular container size, can include a width that substantially spans from the bottom to the neck of the particular desired container. The indicia positioned on that label can substantially traverse this width to increase the readability of that indicia or the amount of information contained in that indicia than is currently conventionally used for most containers, especially those used for larger pharmaceuticals or larger dose pharmaceuticals. Potentially, the orientation of the letters and words in the indicia can be such that the reading of a line of indicia requires little to no movement of the container in the larger size containers.

Additionally, a pharmaceutical storage system can comprise a container including a bottom, a neck having a container engagement device, and a body having an external surface and a length measured from the neck to the bottom. The pharmaceutical storage system can included a closer having a closure engagement device shape to engage and removably attach to the container engagement device. Also, an included label system can have a substrate removably adhered to a first label having a first perimeter and a second label having a second perimeter. The second perimeter can be larger than the first perimeter and containing the first perimeter, while each label can include a first and second label end. At least one of the labels can be shaped to fit on the external surface of the container between the neck and the bottom and space the first label end from the second label end. A third label having a third perimeter can be included where the third perimeter is larger than the first and second perimeters and contains the first and second perimeters.

Each label can include a plurality of panels and a connector between each adjacent panel and each panel of the first label can be positioned within a panel and a connector of the second label. Each connector of the first label can be positioned within a panel and a connector of the second label.

It is therefore a general object of the present invention to provide improved labeling for pharmaceutical containers.

Another object of the present invention is to provide multiple labeling options for a user of labeling of pharmaceutical containers.

Still another object of the present invention is to provide a system for selecting a labeling to maximize the readability and/or amount of information carried in a label of a pharmaceutical container.

Still another object of the present invention is to provide a labeling method in which multiple sized labels are nestled on a single substrate.

Yet still another object of the present invention is to provide a labeling system such that multiple sized labels are nestled on a single substrate.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1A:
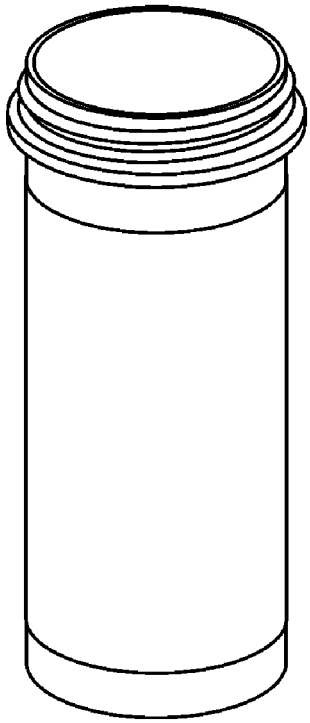
FIG. 1A (PRIOR ART)
FIG. 1A shows an example of a conventional label placed on a smaller sized pharmaceutical bottle.
Figure 1B:
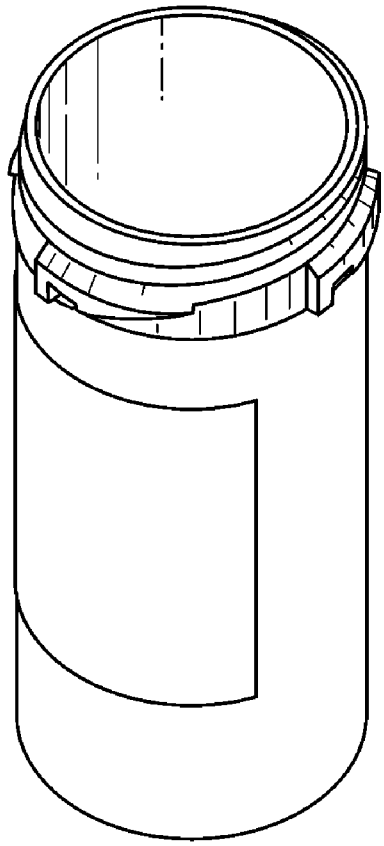
FIG. 1B (PRIOR ART)
FIG. 1B shows the same conventional label placed on a larger pharmaceutical container.
Figure 2A:
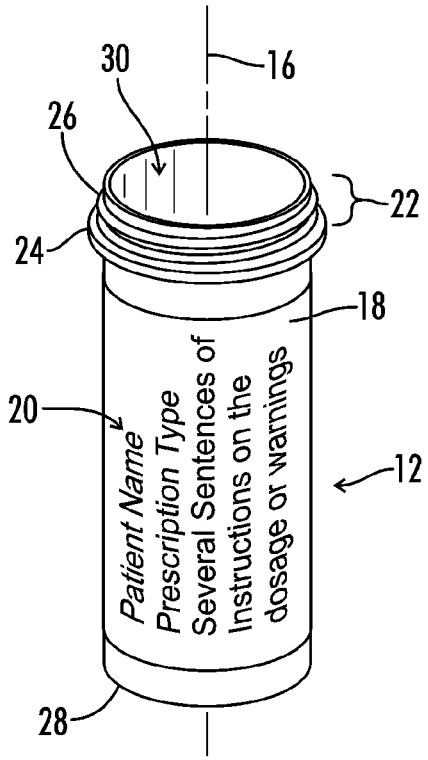
FIG. 2A shows an example of a label made and selected in accordance with the current invention depicted on a smaller container.
Figure 2B:
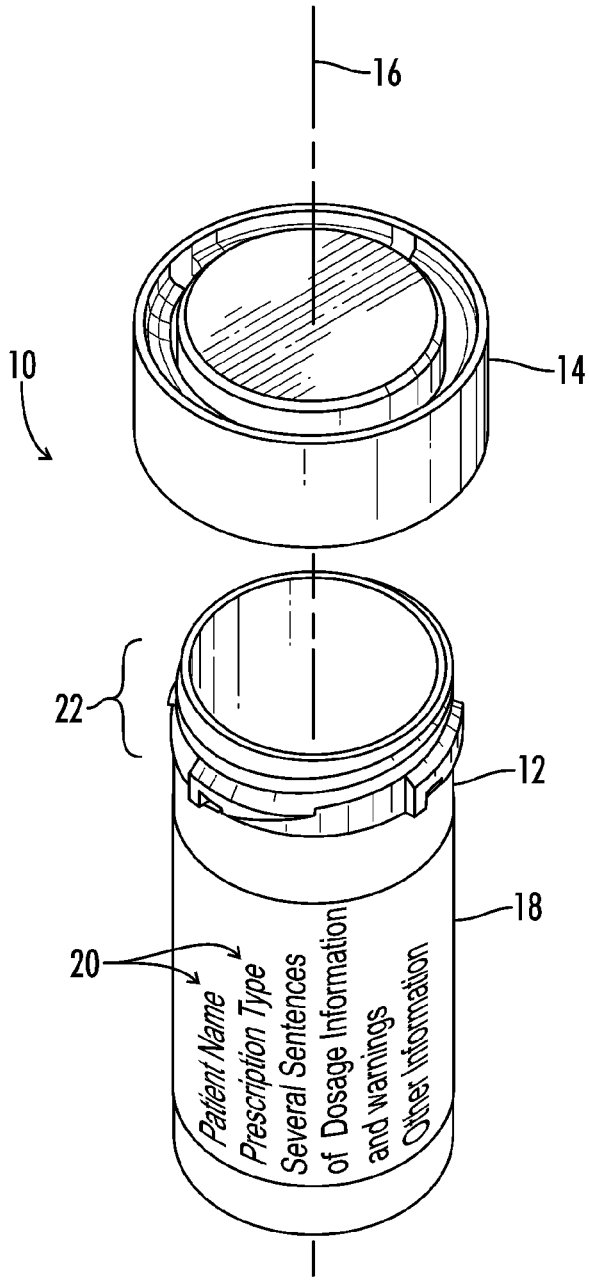
FIG. 2B shows a label made and selected in accordance with the current invention positioned on a larger container.

As seen in FIGS. 1A and 1B, a conventional label is selected to correspond to the size requirements of the smallest container. This, while potentially beneficial for the smaller container, leaves a large amount of unused space on the larger container. As such the indicia, such as the font style, size and type can be limited based upon the size of the smaller container. Various instructions and warnings typically are either placed in an overlapping fashion, use smaller type or less readable font than preferred, and/or are not typically maximized for information transfer to the end user of the pharmaceuticals.

The current invention includes a label 18 positioned on a pharmaceutical container 12 that is used for storage and dispensing of pharmaceuticals. The pharmaceutical container 12 includes a closure 14 to facilitate storage of the pharmaceuticals. The container 12 can take various shapes as known in the art, such as circular, or can be designed to be triangular, quadrilateral, and the like.

The container 12 includes a neck 22 having a rim 24 and engaging device 26. The engaging device 26 contacts the closure 14 to secure the closure 14 to the container 12. The engaging device 26 is designed to interact with the closure 14 to secure the pharmaceuticals contained on the inside of the container 12. The label 18 can be selected such that a substantial amount of space between the bottom 28 of the container 12 and rim 24, and preferably most or almost all of the space, is used to transfer information to the user of the pharmaceuticals. The preferably selected label 18 can include a length that substantially spans the distance between the neck 22 and bottom 28 and that length can depend on the container 12 to which the label 18 is to be affixed.

The label 18 generally comprises traditional medical information such as the patient name, pharmaceuticals, dosage, warnings, and other typical prescription label information. The label 18 can includes an advertisement 30 that is preferably separated from the label 18. Alternately, the advertisement 30 can be included as a section, or part, of the label 18 before the label is affixed to the container 12. For example, the advertisement 30 can be printed on the same substrate as the label 18 or the advertisement 30 can be positioned over a portion of the label 18. The advertisement 30 and/or label 18 can substantially span a distance between the rim 24 and bottom 28 of the container 12.

Figure 3:
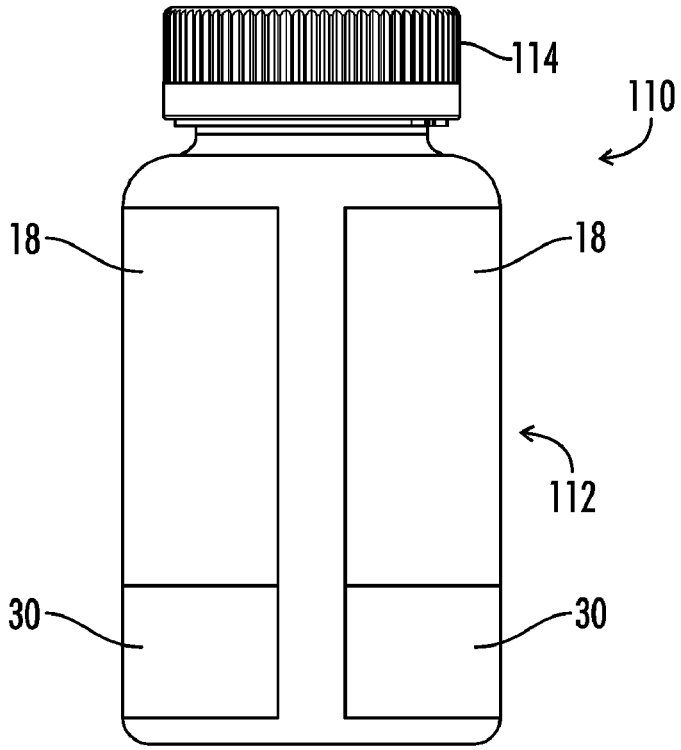
FIG. 3 is a side view of labeling made and selected for an alternate pharmaceutical storage system.
Figure 4:
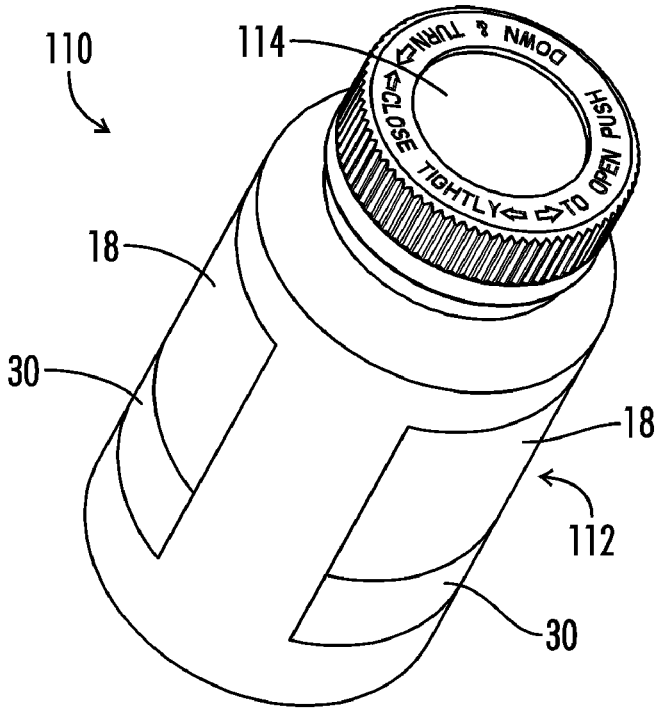
FIG. 4 is a perspective view of FIG. 3.
Figure 5:
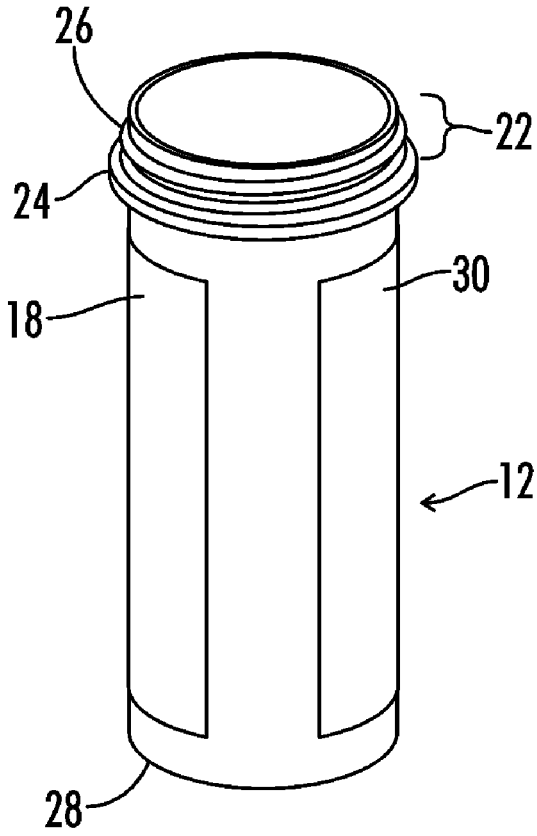
FIG. 5 shows an alternate embodiment of a pharmaceutical system including labeling made and selected in accordance with the current disclosure having medical information labeling and advertisements.
Figure 6:
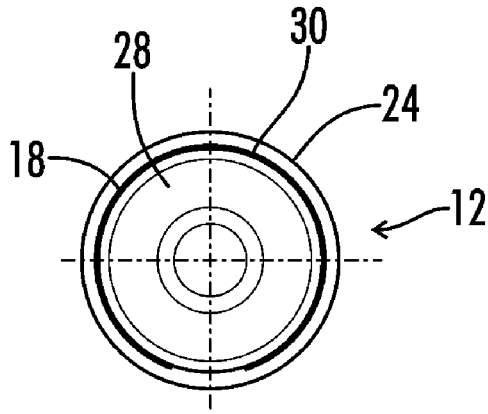
FIG. 6 is a bottom view of the embodiment shown in FIG. 5.

FIGS. 2A and 2B and 5 and 6 show alternate embodiments of the container having a different engaging device for engagement with the closure. The label 18 can be configured substantially the same as described above. FIGS. 3 and 4 disclose yet another pharmaceutical system 110 having an alternate closure 114 and container 112.

As can be seen in FIGS. 7A-9, a substrate 50 can include a label system with multiple labels sizes 18A, 18B, and/or 18C that allow a user, such as a pharmacist to select the label 18A, 18B, and/or 18C that closely matches or conforms to the size of the desired container. The labels, or sub-labels, 18A-18C can be the traditional peel and stick design such that the peel and stick paper portions is glued to a lower, bonded paper section. These labels can have their individual preparations, and/or sections to which they are peeled from the substrate 50.

Looking at FIGS. 7A-D, an example of a substrate having nestled sub-labels 18A, 18B, and 18C is shown. The substrate 50 is shown in sheet form but could also be in a roll form. Each of the sub-labels 18A, 18B, and/or 18C have perforations around the edge that allow the traditional peel and stick portion to be glued to a lower, bonded paper section. Preferably the software that prints the labels has a predetermined container size to which it matches the proper label size, for example 18A, 18B, or 18C, and prints the indicia on there accordingly.

Figure 7A:
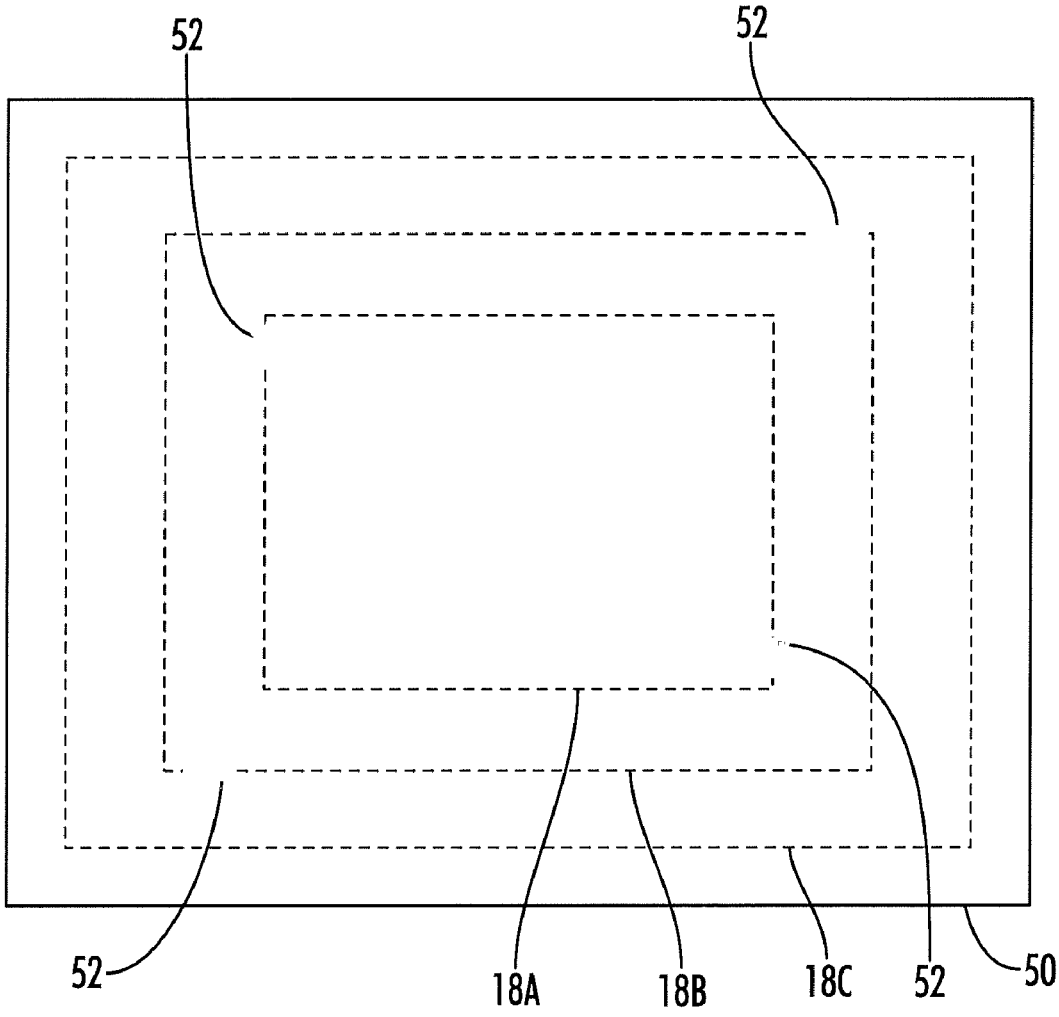
FIG. 7A is an example of a nestled labeling system made in accordance with the current disclosure.
Figure 7B:
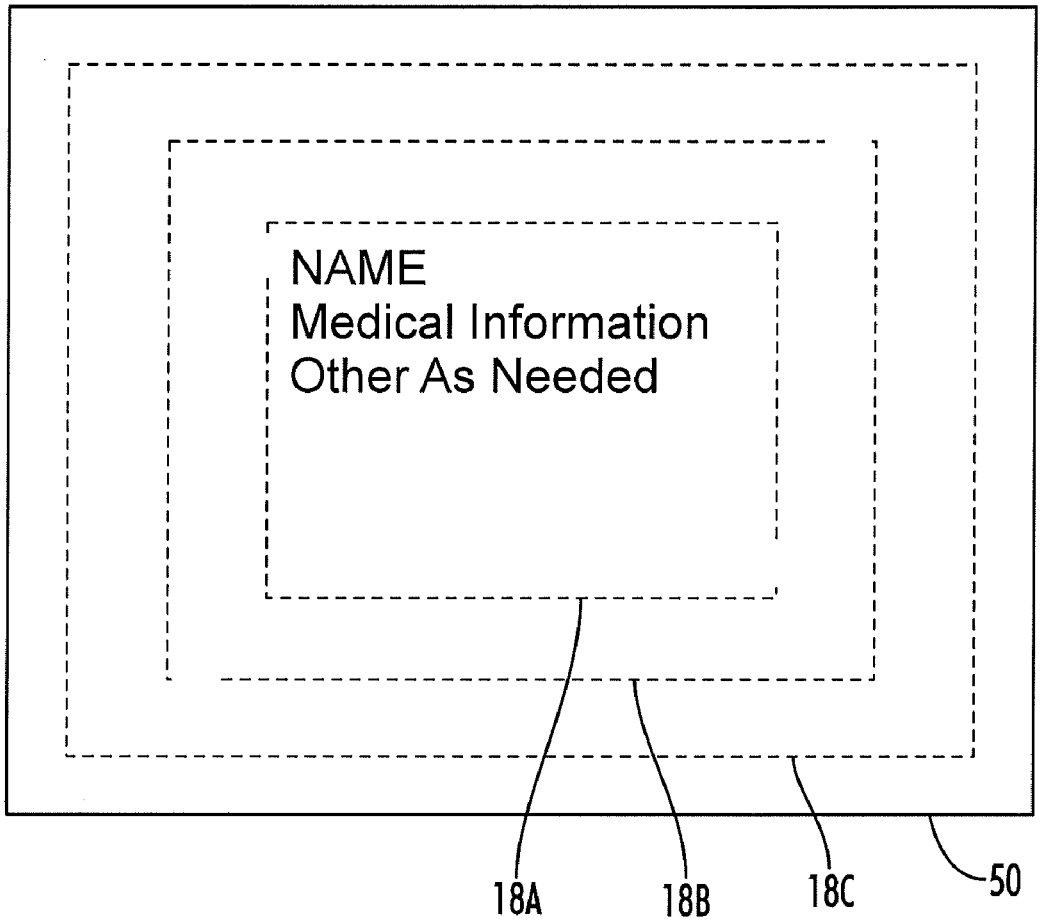
FIG. 7B is an example of a view similar to FIG. 7A showing the indicia positioned on a smaller sized label.
Figure 7C:
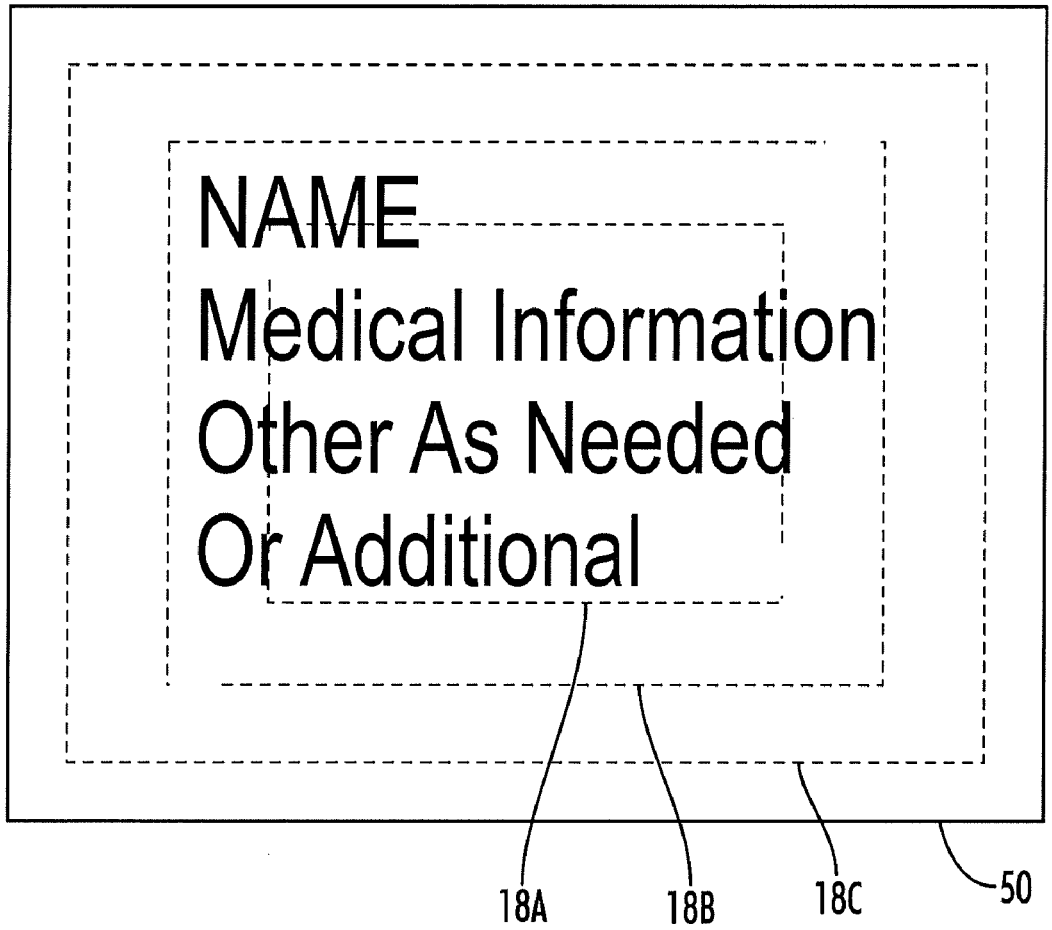
FIG. 7C is an example similar to FIG. 7A showing the indicia positioned on a middle sized label.
Figure 7D:
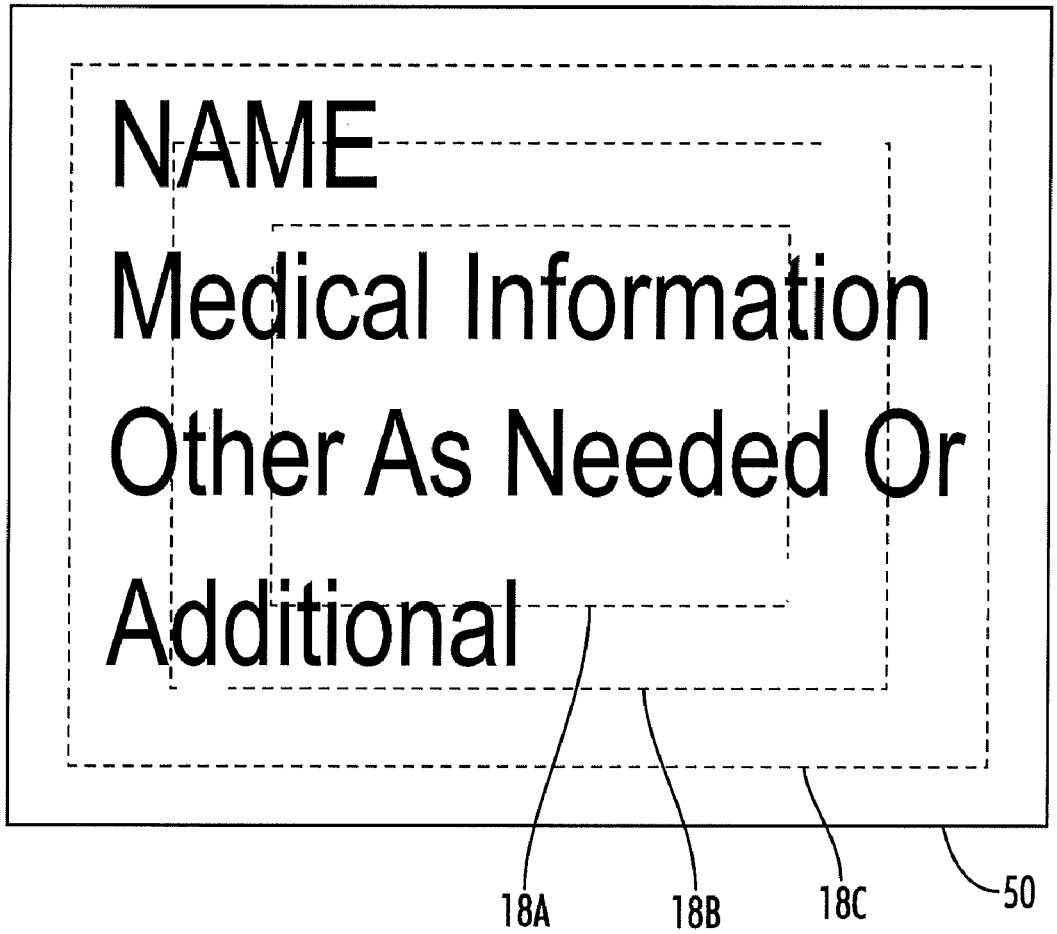
FIG. 7D is a view similar to FIG. 7A showing the indicia positioned on a larger sized label.

As best seen in FIG. 7A, the various tab portions 52, or breaks, facilitate the use of the larger labels, such as 18B and 18C. The tabs 52 can be used to maintain the integrity of, or hold, the interior portion of label 18B, which is basically label 18A, to label 18B when a medium or middle-sized label is desired, such as the 18B size label. The tabs 52 can be used to hold these subsections of larger label 18C that correspond with the 18A and 18B sections such that the label 18C can be pulled from the substrate as a single piece. The tabs 52 preferably lack the perforations, or separate the perforations, of the label 18A and/or 18B to which the tabs 52 are incorporated. Each tab 52 can be positioned diagonally opposed to the other tab 52 within the particular label—i.e. tabs 52 positioned at roughly the bottom right and top left corners in 18A. Multiple labels within the label system can have the tabs 52 circumferentially rotated on labels that are positioned radially outward from internal labels—i.e. tabs 52 positioned at the top right and bottom left corners on 18B—this is best viewed in FIG. 7A.

A user, such as a pharmacist, can break the tabs 52 such that when the smaller size labels, such as 18A or 18B, are used the larger and peripherally exterior portions, 18B and C and 18C, respectfully, are is not attached to the wanted smaller label portions, namely 18A or 18B, as preferred.

Figure 9:
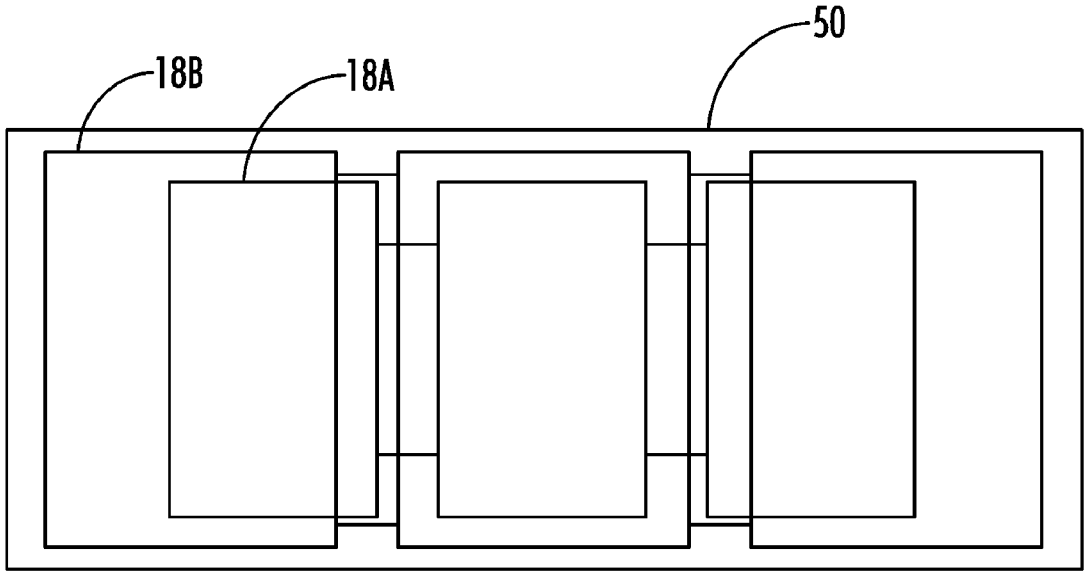
FIG. 9 is another example of labeling produced from a printing system in accordance with the current disclosure showing nestled labeling.

Looking at FIG. 9, another example of a substrate having nestled sub-labels 18A and 18B is shown. As before, the substrate 50 is shown in sheet form but could also be in a traditional roll form. These "nestled" labels could be formed on the top of a dual web sheet label that passes through a laser printer, or designed to be manufactured on a roll for use in direct thermal or indirect thermal roll label printers. Again, the process by which each label is selected could be manual or automated.

In this embodiment, various indicia sections as well adjoining tabs of the smaller label 18A reside, or are contained, inside the larger sections and the adjoining tabs of the larger label 18B such that selection and subsequent removal of the larger label 18B from the substrate 50 would preferably include the removal of all of the smaller label 18A. This facilitates uninterrupted printing on the larger label 18B. Additionally, printing on just the smaller label 18A would allow separation of the label 18A from the label 18B and the substrate 50.

Figure 8:
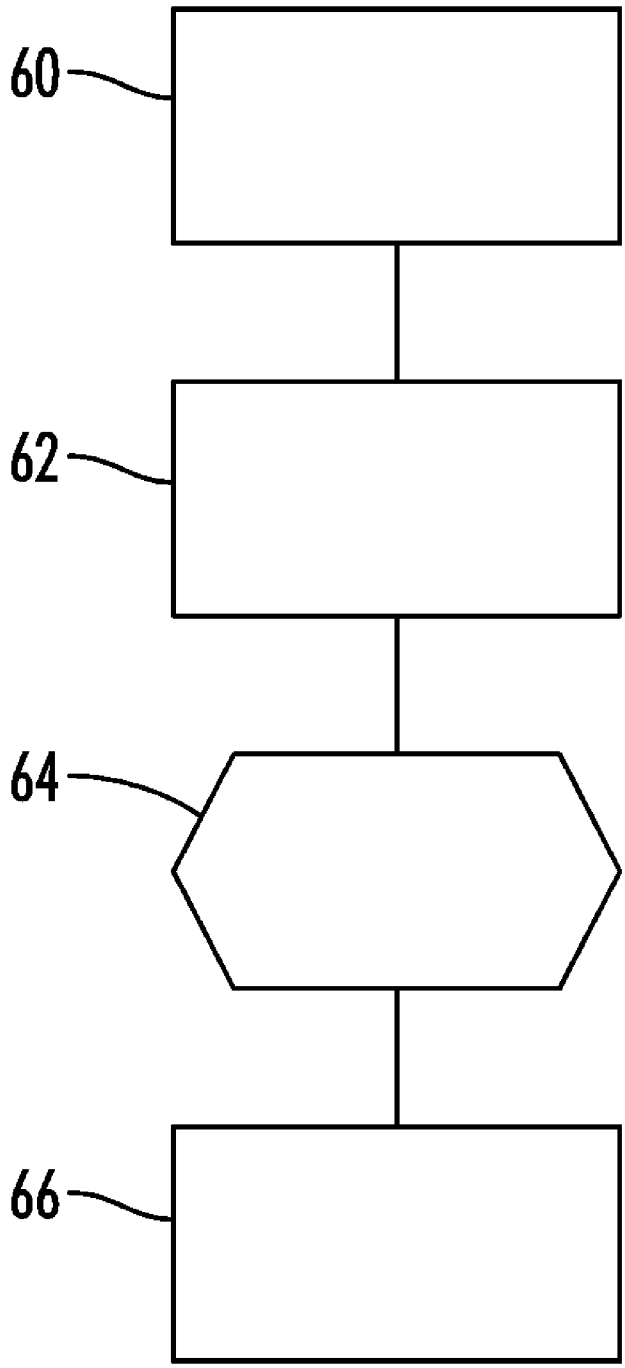
FIG. 8 is a schematic of a method of selecting a label for a preferred container in accordance with the current disclosure.

Now turning to FIG. 8, a method of selecting a desired label for a given container is schematically shown. This includes the step 60 of obtaining a pharmaceutical order which includes the type of pharmaceuticals including the size of individual pharmaceuticals as well as the dosage amounts. This information can be used to determine the volume of the pharmaceutical to be dispensed. Next a container is selected based upon proper federal guidelines based upon that pharmaceutical type, dosage, and size as schematically illustrated in 62. Next a desired label is selected in 64 for that container. This step can be performed by a user, such as a pharmacist where he or she picks a label size from the programming, for example, 18A-18C. Alternately, this process can be handled by automated systems, such as a computer and printer, that know the size of the container to be used and can produce, such as by printing, the desired label size based upon that container size. Next, the label is placed on the container in operation 66 for a user, for example the individual for whom the pharmaceuticals are dispensed, to obtain information concerning the pharmaceuticals therein.

Thus, although there have been described particular embodiments of the present invention of a new and useful Nestled Labels for Medicine Containers, it is not intended that such references be construed as limitations upon the scope of this invention except as set forth in the following claims.

What is claimed is:

1. A pharmaceutical storage system comprising:

a container including a bottom, a neck having a container engagement device, and a body having an external surface and a length measured from the neck to the bottom;

a closure including a closure engagement device shaped to engage and removably attach to the container engagement device;

a label system including a substrate removably adhered to a first label and a second label, the first label having a first perimeter and a first end and a second end, the second label having a second perimeter and a first end and a second end, the second perimeter being larger than the first perimeter and containing the first perimeter;

at least one of the labels shaped to fit on the external surface of the container between the neck and the bottom and space each first label end from its respective second label end of said at least one of the labels; and wherein the perimeter of the first label is perforated inside the perimeter of the second label and the perimeter perforations of the first label include at least one break in the perforations positioned to both maintain the integrity of the first label within the second label when the second label is removed from the substrate and permit separation of the first label from the second label when the first label is removed from the substrate.

2. The system of claim 1 wherein the perforated perimeter of the first label includes a first break and a second break in the perforations, each break positioned diagonally opposed to the other break.

3. The system of claim 1 wherein indicia printed on the first label is positioned within the first perimeter.

4. The system of claim 1 wherein indicia printed on the first label extends through the first perimeter.

5. The system of claim 1, further including a third label having a third perimeter, the third perimeter being larger than the first and second perimeters and containing the first and second perimeters.

6. The system of claim 5 wherein the perimeter of the second label is perforated inside the perimeter of the third label.

7. The system of claim 6 wherein:

the perforated perimeter of the second label includes a first break and a second break in the perforations, each break positioned diagonally opposed to the other break; and indicia printed on the third label extend through the second perimeter.

8. A pharmaceutical storage system comprising:

a container including a bottom, a neck having a container engagement device, and a body having an external surface and a length measured from the neck to the bottom;

a closure including a closure engagement device shaped to engage and removably attach to the container engagement device;

a label system including a substrate removably adhered to a first label having a first perimeter, a second label having a second perimeter, and a third label having a third perimeter, wherein the third perimeter contains the second perimeter, and the second perimeter contains the first perimeter, the perimeter of the first label is perforated inside the perimeter of the second label, and the perimeter of the second label is perforated inside the perimeter of the third label;

at least one of the labels is shaped to fit on the external surface of the container between the neck and the bottom and space;

wherein the perimeter perforations of the first label includes a first break and a second break in the perimeter perforations, each break positioned diagonally opposed to the other break, the perimeter perforations of the second label includes a first break and a second break in the perimeter perforations, each break positioned diagonally opposed to the other break, and each break in the perimeter perforations of both the first label and the second label connects the adjacent labels;

the first break and second break of the first label are shaped and positioned to maintain the integrity of the first label within the second label when the second label is removed from the substrate and allow the individual selection of the first label from the second label when the first label is removed from the substrate, and the first break and second break of the first label and the first break and second break of the second label are shaped and positioned to maintain the integrity of the first label within the second label and the second label within the third label when the third label is removed from the substrate and allow the individual selection of the second label from the third label when the second label is removed from the substrate.

* * * * *